US006823949B2

(12) United States Patent
Giardino

(10) Patent No.: US 6,823,949 B2
(45) Date of Patent: Nov. 30, 2004

(54) MODULAR CONTROL APPARATUS FOR A POWER IMPACT TOOL

(75) Inventor: David A. Giardino, Rock Hill, SC (US)

(73) Assignee: Chicago Pneumatic Tool Company, Rock Hill, SC (US)

( * ) Notice: Subject to any disclaimer, the term of this patent is extended or adjusted under 35 U.S.C. 154(b) by 15 days.

(21) Appl. No.: 10/213,702

(22) Filed: Aug. 6, 2002

(65) Prior Publication Data

US 2004/0026096 A1 Feb. 12, 2004

(51) Int. Cl.[7] ..... B25D 15/00
(52) U.S. Cl. ..... 173/93; 173/93.5; 173/93.7
(58) Field of Search ..... 173/93, 93.5, 93.7, 173/138, 169, 177, 178, 180, 218

(56) References Cited

U.S. PATENT DOCUMENTS

| | | | | | |
|---|---|---|---|---|---|
| 2,405,172 | A | | 8/1946 | Yanchenko | |
| 2,727,598 | A | * | 12/1955 | Mitchell | 173/178 |
| 2,740,507 | A | * | 4/1956 | Shaff | 173/178 |
| 3,033,236 | A | | 5/1962 | Rayman et al. | |
| 3,195,655 | A | * | 7/1965 | Karden | 173/1 |
| 3,195,702 | A | * | 7/1965 | Alexander | 173/176 |
| 3,253,662 | A | * | 5/1966 | Sacchini | 173/177 |
| 3,336,840 | A | | 8/1967 | Alexander | |
| 3,643,749 | A | * | 2/1972 | Pauley | 173/176 |
| 3,696,834 | A | * | 10/1972 | Vonhoff, Jr. | 137/596 |
| 3,741,319 | A | | 6/1973 | Kotone | |
| 3,951,217 | A | * | 4/1976 | Wallace et al. | 173/169 |
| 4,120,604 | A | | 10/1978 | Garofalo | |
| 4,418,764 | A | * | 12/1983 | Mizobe | 173/177 |
| 4,434,858 | A | * | 3/1984 | Whitehouse | 173/177 |
| 5,492,185 | A | * | 2/1996 | Schoeps et al. | 173/177 |
| 6,026,910 | A | | 2/2000 | Masterson et al. | |
| 6,047,779 | A | | 4/2000 | Wallace | |
| 6,155,355 | A | * | 12/2000 | Holmin | 173/176 |
| 6,220,367 | B1 | | 4/2001 | Masterson et al. | |
| 6,318,479 | B1 | | 11/2001 | Giardino et al. | |

* cited by examiner

*Primary Examiner*—Scott A. Smith
*Assistant Examiner*—Chukwurah Nathaniel
(74) *Attorney, Agent, or Firm*—Schmeiser, Olsen & Watts

(57) ABSTRACT

The invention comprises a power impact torque tool that is torque-limited by a novel torque-timing device that controls the amount of time that the tool motor operates after the operator initiates tool operation. The invention also includes the torque-timing device itself and with other tools. The invention further includes the torque-timing device in the form of a modular, releasably-attachable, user-adjustable control apparatus for tools powered by compressable fluids. The torque-time-limiting device allows the user to adjust a needle valve that controls the filling of a reservoir which, when full, provides the pressure required for actuating a shut-off valve.

38 Claims, 4 Drawing Sheets

MODULAR CONTROL APPARATUS FOR A POWER IMPACT TOOL

FIELD OF INVENTION

This invention relates generally to the field of power impact tools and, more particularly, to a modular control apparatus for a power impact tool and more specifically to timing devices.

BACKGROUND OF INVENTION

Power impact tools (e.g., pneumatic, hydraulic, electric, etc.) are well known in the art. Power impact tools produce forces on a workpiece by the repeated impact of a motor-driven hammer on an anvil that is mechanically connected, directly or indirectly, to exert a force on the workpiece. Some power impact tools exert linear forces. Other power impact tools exert torque, which is a twisting force.

One difficulty in current power impact tools is that power may be applied too long to the workpiece. The accumulation of impacts on any already tightened workpiece may cause damage. Current power impact tools shut off when the operator manually enables shutting off. For example, in a pneumatic hand tool such as a torque wrench, the operator releases the trigger valve to shut off the supply of compressed air to the tool motor. The number of impact forces delivered to the workpiece depends on the reflexes and attentiveness of the tool operator. During any delay, the workpiece may become overtorqued and damaged.

Accordingly, there is a need in the field of power impact tools for ways to provide more predictable amounts of torque ultimately applied to a workpiece. Additionally, there is a need for a control apparatus that will limit the time that a force of a power impact tool is applied to a workpiece.

SUMMARY OF INVENTION

The present invention provides an apparatus and method for use in controlling power impact tools.

An first general aspect of the invention provides a modular control apparatus comprising:

a modular structure;

at least one control valve; and an adjustment mechanism for controlling at least one limit of the control valve.

A second general aspect of the invention provides a power impact tool comprising:

a housing;

an air motor contained within said housing; and a modular, releasably-attachable, user-adjustable control apparatus.

A third general aspect of the invention provides a power impact tool comprising:

a housing;

an air motor contained within said housing, wherein said air motor provides a first torque output; and a modular, releasably-attachable, user-adjustable control apparatus;

An fourth general aspect of the invention provides a power impact tool comprising:

a housing;

an air motor within said housing;

a workpiece adapter operatively attached to said air motor; and a modular, releasably-attachable, user-adjustable control apparatus.

The foregoing and other features of the invention will be apparent from the following more particular description of various embodiments of the invention.

BRIEF DESCRIPTION OF DRAWINGS

Some of the embodiments of this invention will be described in detail, with reference to the following figures, wherein like designations denote like members, wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

The modular control apparatus is used with, or as part of, a power impact tool and allows for time-limiting the torque output. Power impact tools can include various power (e.g., pneumatic, hydraulic, electric, etc.) impact tools. This modular control apparatus, when used with a power impact tool, for example with a pneumatic impact tool, provides a fixed duration of torque from the air motor within the tool, to a workpiece, such as a nut or bolt. A motor, as defined and used herein, is any device for converting a first flow of energy into kinetic energy. For example, an air motor converts the energy of a flow of expanding compressed gas into the rotational motion of a mechanical drive shaft. For another example, an electric motor converts a flow of electricity into the rotational motion of a mechanical drive shaft. For yet another example, the drive piston and valves of a jack hammer form a motor to convert the energy of an expanding compressed fluid into linear motion of a mechanical drive shaft. For a final example, a hydraulic motor converts the kinetic energy of a flowing, slightly compressible fluid (hydraulic fluid) into the rotational motion of a mechanical drive shaft. The drive shaft, in each embodiment, is rotated by the motor, and tools, for operating on work pieces (workpiece adapters) are mechanically connected directly or indirectly between the drive shaft and the work piece.

Figure 1B:
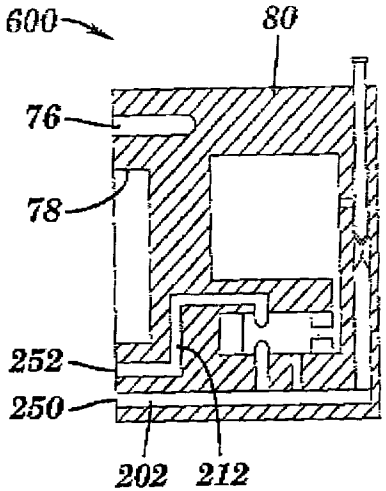
FIG. 1B depicts a cross-sectional view of an embodiment of a modular, releasably-attachable, user-adjustable, control apparatus, in accordance with an embodiment of the present invention.
Figure 1A:
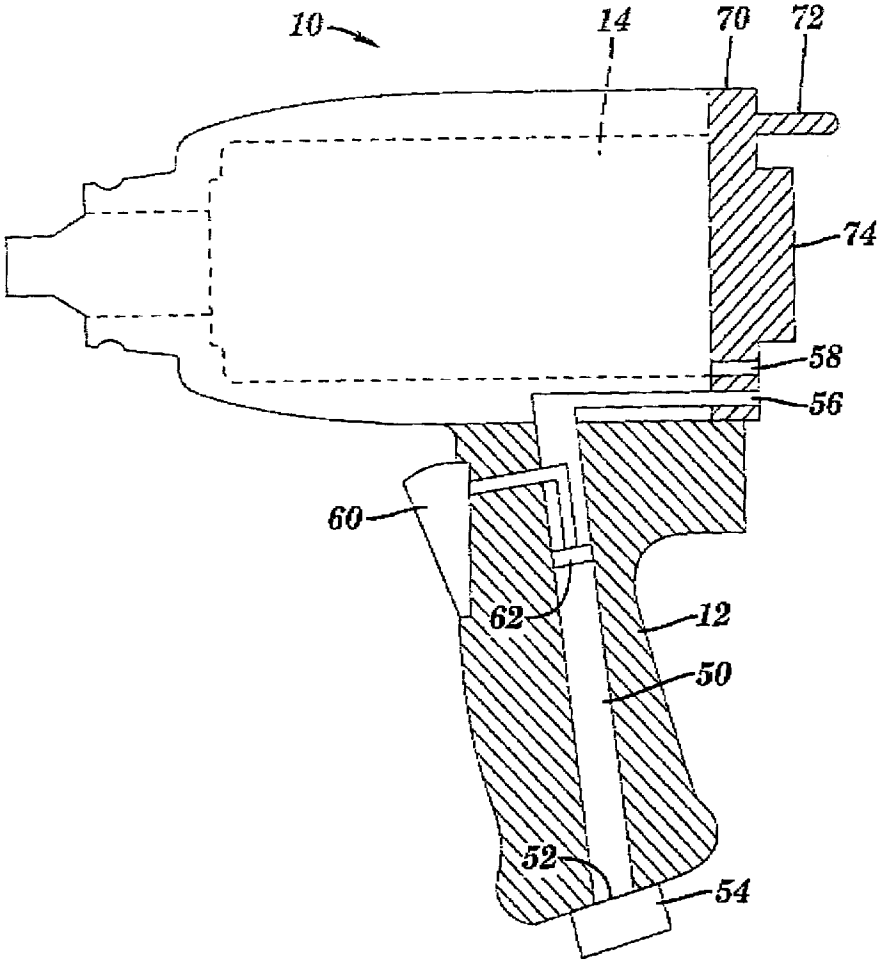
FIG. 1A depicts a cross-sectional view of an alternative embodiment of a power impact tool adapted to receive a modular, releasably-attachable control apparatus, in accordance with an embodiment of the present invention.

Referring now to FIG. 1A, an embodiment of a power impact tool 10 is shown in a vertical section through the centerline of the tool 10. The tool 10 has a handle 12 containing a channel 50 for receiving a compressible fluid through a port 52 at the base of the handle 12. A channel is a confined path for the flow of a compressible fluid. Channels may be pipes, hoses, bores formed in a block of material, or similar flow constraints.

A compressible fluid, as defined and used herein, is a fluid with a bulk modulus that is less than the bulk modulus of water. Compressible fluids with low bulk moduli transfer energy by converting the potential energy of their compressed state into the kinetic energy of an expanding fluid and then into the kinetic energy of a motor rotor. Elemental gases, such as helium and nitrogen, and mixed gases such as air, are compressible fluids with low bulk moduli. Slightly compressible fluids have high bulk moduli and are used for force transmission. Hydraulic fluids, for example, typically have higher bulk moduli. Either type of compressible fluid can transfer energy into a motor.

The port 52 is equipped with a fitting 54 for connecting to a supply of compressed fluid. A supply of compressible fluid may be, for example, a compressed air hose such as is used in an auto repair shop to power pneumatic tools. Within the channel 50 is a manually operated valve 62, shown in FIG. 1 as a trigger valve 62, which enables the tool-user to regulate the flow of compressible fluid through the channel 50. By depressing the trigger 60, the valve 62 is opened, thereby channeling the compressible fluid toward a motor 14 of the tool 10. The channel 50 extends to a backplate 70 of the tool where the channel 50 terminates at a port 56 sized and shaped to receive (see FIG. 1B) a corresponding port 250 to a first channel 202 in a modular control apparatus 600. Thus, the first channel 202 is the input channel.

A modular control apparatus 600 is a first apparatus that controls at least one function of at least one second apparatus. Furthermore, a modular control apparatus 600 is modular in that it may be manipulated as a single physical unit (a module). The module comprises a generally solid block, or body, within which are formed the mechanisms which implement control functions. The body may be created from a single block or may be built up from a plurality of ub-blocks. The modular control apparatus 600 may be manipulated into a relationship with a second apparatus in which interaction between the modular control apparatus 600 and a second apparatus results in a change in the operation of the second apparatus. For some examples in the field of pneumatics, a modular control apparatus 600 may shut off air flow to a tool 10 (a second apparatus) after a user-selected time, may oscillate the direction of air flow, as in a jack hammer, or may change the pressure of the air entering the second apparatus.

The modular control apparatus 600 is configured to be releasably attachable to the tool 10. The apparatus is releasably attachable when the connections between the modular control apparatus 600 and the tool 10 can be opened and closed by the tool user. The connectors may be bolts, clamps, latches, or similar devices known in the art. In an embodiment, the connections can all be opened or all be closed by a single motion of the user's hand.

Also located on the backplate 70 is a port 58 sized and shaped to receive the compressed fluid which is discharged from (see FIG. 1B) an output port 252 of a second channel 212 of the modular control apparatus 600. The second channel is the output channel. The backplate 70 may be, for example, the backplate 70 of a Model 749 pneumatic torque wrench made by Chicago Pneumatic Tool. In an embodiment, the backplate 70 has a cylindrical protrusion 74, perhaps accommodating a motor bearing within, which is used an alignment mechanism for aligning the modular control apparatus 600 to the tool 10.

Referring to FIGS. 1A and 1B, in an embodiment, the modular control apparatus 600 has a structure 80 containing a cavity 78 sized and shaped to slidingly receive the cylindrical protrusion 74 of the backplate 70. The purpose In an embodiment, the backplate may further comprise an alignment dowel 72 which is sized and shaped to be slidingly received into a cavity 76 in the modular control apparatus 600. In an alternate embodiment, the cavities 76 and 78 may be in the backplate 70 and the cylindrical protrusion 74 and alignment dowel 72 may be part of the modular control apparatus 600. In another alternate embodiment, the backplate 70 has at least one alignment mechanism and at least one cavity, with at least one corresponding cavity and at least one corresponding alignment mechanism integrated into the modular control apparatus 600.

In alternative embodiments, the backplate 70 may be an adapter 900 which provides an interface between a tool 10 and the modular control apparatus 600. In such retrofit cases, an adapter 900 may be designed for each uniquely designed tool. On the modular control apparatus-receiving side of the adapter 900, at least a portion of the adapter may be configured like the backplate 70 of a tool 10 for which the modular control apparatus 600 was originally designed. Remaining portions of the adapter 900 provide two channels for compressible fluids: a first adapter channel 910 between the compressible fluid supply and the input port 250 of the modular control apparatus 600 and a second adapter channel 920 between the discharge port 252 of the modular control apparatus 600 and the tool 10 motor 14. The adapter 900 also provides sufficient structure 70 and attachment mechanisms 80 for securing the adapter 900 to the tool 10 and to the modular control apparatus 600.

Figure 2:
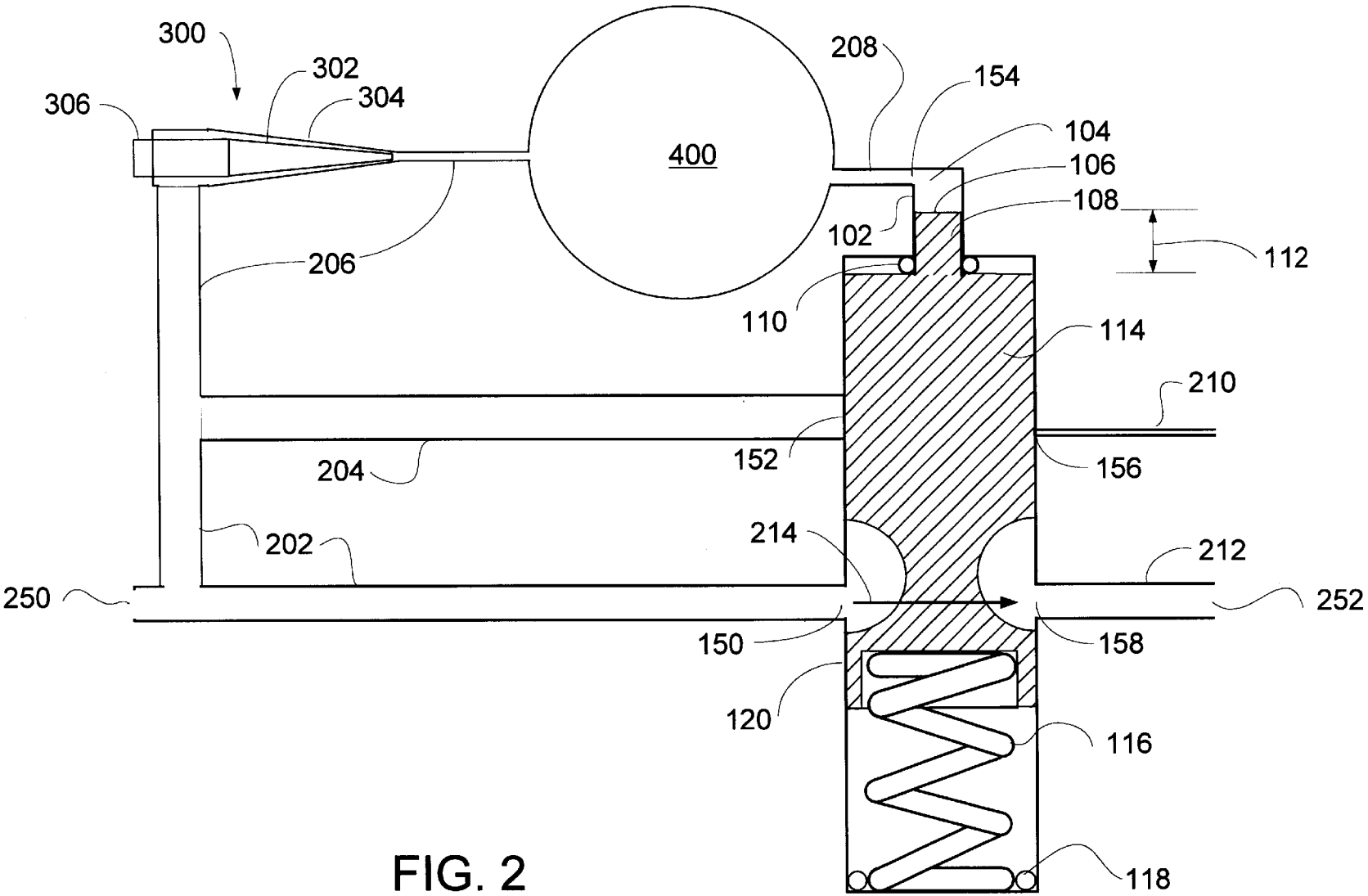
FIG. 2 depicts a diagrammatic view of an embodiment of a modular, releasably-attachable, user-adjustable control apparatus, in accordance with an embodiment of the present invention.

FIG. 2 shows an embodiment of a modular control apparatus 600 in a semi-diagrammatic view. An embodiment of the modular control apparatus 600 contains an automatic shutoff valve 100 that shuts off the flow 214 of compressible fluid to the motor at a user-adjustable time after the beginning of flow of compressible fluid through the modular control apparatus 600. In the embodiment of FIG. 2, compressible fluid flows through an input port 250 into a first channel 202, through the biased-open valve 100, into and through a second channel 212, and is discharged from port 252 into the inlet 58 (FIG. 1A) of the motor of the tool.

The valve 100 comprises a valve chamber 120, a valve body 114, a biasing mechanism 116, and seals 110 and 118. The valve chamber 120 has ports 150–158 to a plurality of channels 202, 204, 208, 210, and 212. The valve body 114 fits slidingly within the valve chamber 120. In the embodiment shown in FIG. 2, the valve body 114 has one degree of freedom of translational motion. In this embodiment, the valve body 114 may also have one degree of freedom of rotational motion because the valve body 114 has rotational symmetry about its long axis. The rotational symmetry of the valve body 114 obviates the need for the valve body 114 to maintain a specific rotational orientation within the valve chamber 120 during operation. The degree of freedom of motion which opens and closes the valve 100 is the operational degree of freedom. In alternate embodiments, the valve body 114 and valve chamber 120 may not be rotationally symmetric. In other alternate embodiments, a valve 100 operates by sliding rotationally instead of translationally. Those having skill in the art will realize the advantages of minimizing the mass of the valve body 114 within the other design constraints.

The biasing mechanism 116 is any mechanism or combination of mechanisms that exerts force on the valve body 114 in one direction aligned to the operational degree of freedom of motion of the valve body 114 and over at least a portion of the range of valve body 114 motion. The biasing mechanism 116 is typically a spring, but may be a compressible fluid or other elastic members.

In the embodiment of FIG. 2, a first end of the valve body 114 has a poppit portion 108. The poppit portion 108 is a rotationally symmetric extension of the valve body 114 with a uniform and smaller diameter than the maximum diameter of the valve body 114. The poppit portion 108 has a predetermined length 112. When the valve body 114 is in its biased position, the poppit portion 108 is received slidingly into a correspondingly narrowed portion 102 of the valve chamber 120. The narrowed portion 102 of the valve chamber 120 may made longer than the poppit portion 108 of the valve body 114, in order to form a chamber 104 for receiving compressible fluid from the reservoir 400. The reservoir 400 is a cavity for accumulating compressible fluid. The receiving chamber (or actuating chamber) 104 may be considered a further extension of the valve chamber 120. In an alternate embodiment, the receiving chamber 104 may be wider than the diameter of the poppit portion 108 of the valve body 114. In another embodiment, the receiving chamber 104 may be an extension of the fifth channel 208 which connects the reservoir 400 to the poppit end, or biased end, of the valve chamber 120. In yet another embodiment, there is no discrete receiving chamber 104, as the narrow poppit portion of the valve chamber 120 is a port directly into the reservoir 400. The end surface 106 of the poppit portion 108 is exposed to the pressure of compressible fluid which may be received in the receiving chamber 104. The pressure of the fluid in the reservoir 400 exerts a force on the end surface 106 of the poppit portion 108 of the valve body 114 and, thereby, on the valve body 114 itself. The receiving chamber 104 may be regarded as an expandable and contractible chamber having one moveable wall, the moveable wall being the end surface 106 of the poppit portion 108 of the valve body 114. In an embodiment wherein the valve operates by rotation, the actuating chamber 104 may be completely separate from the main valve chamber.

The pressure of the compressible fluid at a given time in the reservoir 400 depends, in the first instance, on the rate of flow into the reservoir 400. The rate of flow is controlled by the setting of a needle valve 300. The needle valve 300 comprises a needle valve seat 304 within a third channel 206, a needle valve body 302, and a user-accessible extension of the needle valve 306. The needle valve seat 304 comprises a channel portion tapered concentric to the needle valve body 302, a shaft bearing to hold the shaft of the needle valve body 302, and a seal to prevent leakage through the shaft bearing. The third channel is the reservoir input channel. In an embodiment, the threaded extension 306 is screwed into a threaded portion 308 of the third channel 206. In an alternate embodiment, the extension 306 is provided with a locking mechanism, for example: a set screw, to prevent vibrations caused by operating the tool to change the setting. The user selects the amount of time between the introduction of compressible fluid into port 250 (as by squeezing the trigger 60 (FIG. 1A)), and the closing of the poppit valve 100 by adjusting the needle valve 300. The higher the rate of flow, the faster the reservoir 400 reaches a pressure sufficient to close the valve 100.

Figure 3C:
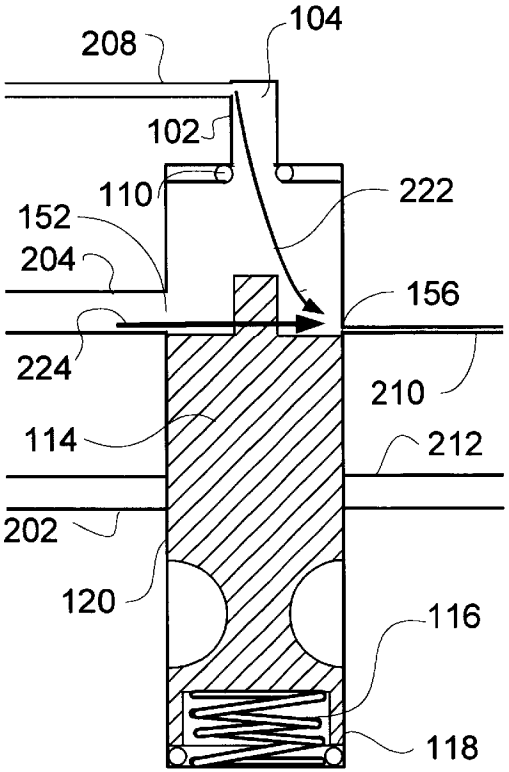
FIGS. 3A–C depict a cross-sectional view of an embodiment of a poppit valve of an embodiment of a modular, releasably-attachable control apparatus, the valve shown in three different operational positions in accordance with an embodiment of the present invention.
Figure 3B:
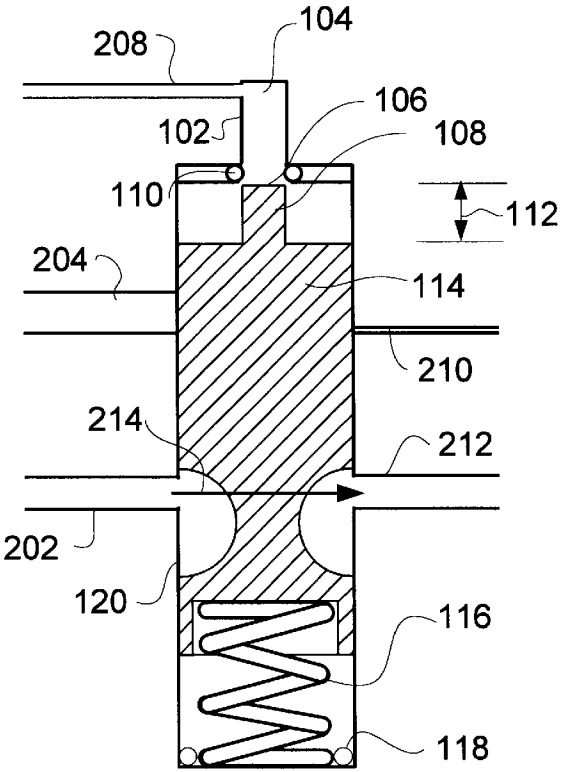
Figure 3A:
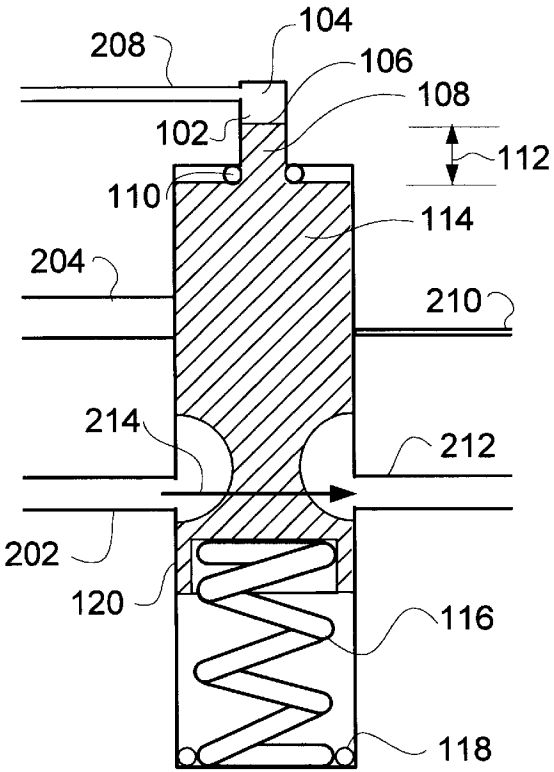

Referring now to FIGS. 3A–C, at a point in the operating cycle where the pressure of the compressible fluid in the receiving chamber 104 exerts more force on the valve body 114 than the biasing mechanism 116, the valve body 114 begins to move against the bias (FIG. 3A). At or near the boundary between the poppit-receiving portion 102 of the valve chamber 120 and the remaining valve chamber 120, the valve chamber has a seal 110. The seal 110 prevents pressure leakage from the receiving chamber 104 into the remaining valve chamber 120 while the valve body 114 moves against the bias for the predetermined length 112 of the poppit portion 108. The valve body 114 moves against the bias by the force exerted on the end surface 106 of the poppit portion 108 by the compressible fluid from the reservoir 400 as it reaches the receiving chamber 104. AS shown in FIG. 3B, when the valve body 114 moves against the bias more than the predetermined length 112 of the poppit portion 108, the seal 110 is avoided, exposing the entire area determined by the cross-section of the valve body 114 to the pressure from the reservoir 400 through receiving chamber 104. The equal pressure on the increased area creates a steep increase in the anti-bias force, thereby slamming the valve body 114 into the anti-biased (closed) position (FIG. 3C). The valve body has a channel through which the compressible fluid flows 214 from the first channel 202 to the second channel 212 when the valve 100 is open (FIG. 3A). This channel is made wider than the valve chamber ports 150 and 158 (FIG. 2) for the first channel 202 and second channel 212 so that flow 214 through the valve 100 is unaffected by the initial anti-bias motion for the predetermined length 112 of the poppit portion 108 (FIGS. 3A–B). Thus, from the perspective of the fluid flow 214 through the valve 100, nothing happens until the valve body 114 slams shut (closes) (FIG. 3C).

When the valve 100 closes (FIG. 3C), two ports 152 and 156 (FIG. 2) are exposed (opened) in the portion of the valve chamber 120 at the biased end of the valve chamber 120. The biased end of the valve chamber 120 is the end of the valve chamber 120 where the valve body 114 rests when the force exerted by the biasing mechanism 116 predominates, as shown in FIG. 3A. When the valve body 114 was in the biased position, or within a predetermined poppit portion 108 length 112 of the biased position, two ports 152 and 156 (FIG. 2) where closed by surfaces of the valve body 114. When the valve body 114 moves to the anti-biased position, as shown in FIG. 3C, the two ports 152 and 156 open. One of these ports 152 receives compressible fluid from a fourth channel 204. The fourth channel 204 connects the first channel 202 (the fluid input channel, FIG. 2) to the valve chamber 120 when the valve body 114 is in the anti-biased position (FIG. 3C). The compressible fluid from the fourth channel 204 provides sufficient pressure to latch the valve 100 in the anti-biased position. The other port 156 in the valve chamber 120 which is opened by the valve body 114 moving to the anti-biased position is a vent port 156. The vent port 156 discharges 222 and 224 compressed fluid into the sixth channel 210. The sixth channel 210 leads to open air, in the case of a pneumatic device, or to a return line in the case of compressible fluids not normally released into the atmosphere, such as hydraulic fluid or dry nitrogen. In any embodiment, the sixth channel 210 drains compressible fluid 222 and 224 and its pressure from the valve chamber 120 and reservoir 400 (FIG. 2) through fifth channel 208 and receiving chamber 104. The sixth channel 210 is sufficiently narrow, as compared with the fourth channel 204 (the latching channel), that the valve 100 will remain latched for as long as compressible fluid is available from the fourth channel 204 by way of the first channel 202. However, when the supply of compressible fluid is shut off, as by releasing the trigger 60 (FIG. 1A) in the present embodiment, the vent 210 dissipates 222 and 224 the pressure from the valve chamber 120 and reservoir 400, allowing the biasing force on the valve body 114 to once again predominate and move the valve body 114 back to its biased position (FIG. 3A).

As shown in FIGS. 3A–C, the biasing mechanism 116 may be a spring. At the anti-biased end of the valve chamber 120, a ring seal 118 provides a bumper for the valve body 114 as it closes. In an embodiment, the ring seal 118 may also aid in sealing the junction between a part of the modular control apparatus 600 (FIG. 1B) containing most of the valve chamber 120, and a second part forming the anti-biased end of the valve chamber 120. In the embodiment of FIGS. 3A–C, the anti-biased end of the valve body 114 has a recess for receiving one end of a coil spring 116. The recess aids in maintaining the alignment of the spring 116 during operation.

Referring back to FIG. 2, the first channel 202 also has a port 160 into a third channel 206 and another port 162 into a fourth channel 204. The third channel 206 provides restricted flow of compressible fluid from the first channel 202 to the reservoir 400. In the embodiment of FIG. 2, the flow restriction is a variable flow restriction wherein the amount of flow restriction is determined by the position of a user-adjustable needle valve 300. Compressible fluid from the third channel 206 flows through the flow restriction into a reservoir 400. The reservoir 400 accumulates compressible fluid, increasing the pressure within the reservoir 400. The reservoir 400 has an outlet through a fifth channel 208 which leads to the receiving chamber 104 portion of the valve chamber 120. The pressure in the receiving chamber 104 exerts a force on an end surface 106 of the poppit portion 108 of the valve body 114. The pressure-derived force opposes the biasing force on the valve body 114.

The rate at which the reservoir fills with compressible fluid is determined by the flow restriction. The nearer the needle valve 300 is to being closed, the longer it takes for the reservoir 400 to accumulate enough fluid to create enough pressure to exert enough force to overcome the biasing force on the valve body 114. Thus the needle valve 300 position determines the amount of time between the beginning of fluid inflow (when the operator squeezes the trigger 60 (FIG. 1A) on a pneumatic torque wrench, for example) and the latching of the valve 100, which shuts off the motor 14 of the tool 10. In addition to minimizing wasted energy and avoiding over-torque conditions by time-limiting tool operation, the needle valve 300 adjustment can be used to compensate for the inevitable changes in the properties of the valve spring 116 over the life of the tool 10. Likewise, the needle valve 300 can be adjusted to provide different times for different work situations. For example, tightening an eight-inch-long bolt would take more time than tightening a one-inch-long bolt.

Referring again to FIGS. 1A and 1B, the valve 100, needle valve 300, and channels 203, 204, 206, 208, 210, and 212 are contained within a modular structure 80 designed to be aligned with and releasably attached to a tool 10. The alignment mechanisms 72, 74, 76, and 78 comprise passive means to ensure that the input port 250 and discharge port 252 of the modular control apparatus 600 mate sealingly with the fluid supply port 56 and the motor inlet port 58 of the tool 10, respectively. In an embodiment, the backplate 70 of-the tool 10 has a cylindrical extension 74 that fits into a corresponding recess 78 in the modular control apparatus 600. The backplate 70 is further equipped with at least one asymmetrically arranged rod 72 corresponding to at least one hole 76 in the modular control apparatus 600. The rods 72 are arranged asymmetrically so that there is only one orientation of the modular control apparatus 600 that will allow the apparatus 600 to be received onto the tool 10. That orientation is the orientation at which the ports of the apparatus 250 and 252 and the tool will line up properly. The attachment mechanism may be as simple as a bolt through the modular control apparatus into a threaded hole in the tool. Those skilled in the art of tool manufacture will be aware of many different ways of making the attachment. The requirements for the attachment mechanism are that it create a seal against leakage of the compressible fluid and that it be reusable.

In a particular embodiment, a modular control apparatus 600 is integrated with a handle 12 comprising a trigger valve 62 and 60 and associated channel 50, port 52, and fitting 54. In this embodiment, the motor 14 and elements of a drive train from a drive shaft of the motor 14 to an output fitting are modular and releasably attach to the integrated handle 12 and modular control apparatus 600. The advantage of this embodiment is that all of the elements controlling the flow of energy to the motor 14 are in one module.

Figure 1C:
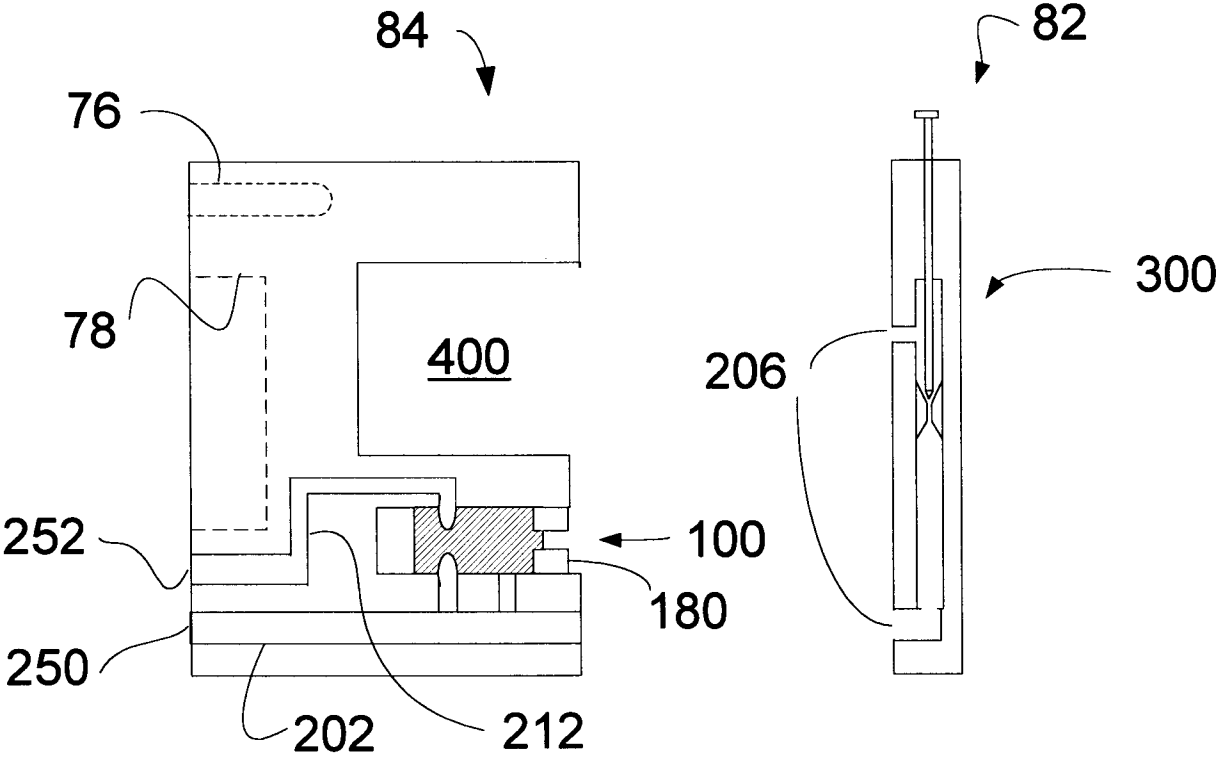

Referring to FIG. 1C, the body of the an embodiment of modular control apparatus 600 may be manufactured from two or more blocks (also called parts or sub-blocks) 82 and 84. In an embodiment, the first block 84 is machined to contain the valve chamber 120 (FIG. 2), reservoir 400, the alignment holes 76 and 78, attachment mechanisms, the input and discharge ports 250 and 252, and all channels except the third channel 206,. All of the features of the first block 84 can be formed by drilling and machining. The second block 82 contains the third channel 206 and the needle valve 300. The third channel 206 may be formed by drilling and machining. In assembly, the spring 116 and bumper seal 118 are inserted before the valve body 114, and an annular chamber end 180 with the poppit seal 110 after the valve body 114. Annular chamber end 180 forms the receiving chamber 104 and the valve chamber extension 102. Installation of the needle valve 300 requires at least one seal (not shown). Assembling the two blocks 82 and 84 together closes the valve chamber 120 and reservoir 400. The blocks 82 and 84 may be bolted together or affixed by permanent means, such as welding. A releasable assembly (bolts) is generally preferred, as it enables maintenance and refurbishment of the valve 100.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A modular control apparatus for a power impact tool the tool comprising at least one motor, the modular control apparatus being releasably attachable to the tool, the apparatus adapted for controlling the duration of flow of a compressible fluid at a discharge port of the modular control apparatus, said apparatus comprising:

a first channel, into which a compressible fluid may be received;

a second channel, from which the compressible fluid may be discharged from the apparatus;

a valve, through which the compressible fluid may pass from the first channel to the second channel;

a third channel, through which the compressible fluid may pass from the first channel to a reservoir;

a fourth channel, through which the compressible fluid may pass from the first channel to a portion of the valve chamber;

a fifth channel, through which the compressible fluid may pass from the reservoir to a portion of the valve chamber;

a sixth channel, through which the compressible fluid may be vented from the valve chamber; and a structure containing the channels, the valve, and the reservoir, the structure being releasably attachable to a tool.

2. The apparatus of claim 1 wherein the first channel comprises:

a first end comprising at least one of a connector, a seal, and a surface for receiving a seal, configured to make a fluid-tight connection with a source of compressible fluid;

a second end comprising an input port into the valve chamber;

a third end comprising a port into a first end of the fourth channel; and a fourth end comprising a port to the third channel.

3. The apparatus of claim 1 wherein the second channel comprises:

a first end comprising a port from the valve; and a second end comprising at least one of a connector or a seal for making a fluid-tight connection at least one of directly or indirectly with a tool.

4. The apparatus of claim 1 wherein the valve comprises:

a valve chamber comprising a plurality of ports;

a biasing mechanism; and a valve body confined within the valve chamber and provided at least one degree of freedom of motion therein.

5. The apparatus of claim 4 wherein the valve body is biased to a biased position by the biasing mechanism, the valve body in the biased position operative to pass the compressible fluid through the valve.

6. The apparatus of claim 5 wherein the valve body may be moved to an anti-biased position, the valve body in the anti-biased position operative to prevent the flow of compressible fluid through the valve.

7. The apparatus of claim 4 wherein the biasing mechanism is a spring.

8. The apparatus of claim 1 wherein the third channel comprises:

a first end sized and shaped for receiving compressible fluid from the fourth end port of the first channel;

a second end comprising a port sized and shaped for discharging compressible fluid into the reservoir; and a middle portion comprising a flow restriction.

9. The apparatus of claim 8 wherein the flow restriction comprises a variable flow restriction.

10. The apparatus of claim 9 wherein the variable flow restriction comprises a needle valve.

11. The apparatus of claim 1 wherein the fourth channel comprises:

a first end receiving compressible fluid from the first channel; and a second end comprising a port to the valve chamber operative to discharge compressible fluid into a portion of the valve chamber to latch the valve body in the anti-biased position when the valve body moves to the anti-biased position.

12. The apparatus of claim 1 wherein the fifth channel comprises:

a first end comprising a port for receiving compressible fluid from the reservoir; and a second end comprising a port for discharging compressible fluid into a portion of the valve chamber.

13. The apparatus of claim 12 wherein the portion of the valve chamber is an expandible and contractible sub-chamber, the sub-chamber having at least one moveable wall.

14. The apparatus of claim 13 wherein the at least one moveable wall comprises at least one surface of the valve body.

15. The apparatus of claim 1 wherein the structure comprises a generally solid block sized and shaped to contain the channels, valve, needle valve, and reservoir and further sized and shaped to accommodate attachment mechanisms, at least one of internally and externally, for attaching the apparatus to a tool.

16. The apparatus of claim 15 wherein the attachment mechanism includes alignment mechanisms.

17. The apparatus of claim 16 wherein alignment mechanisms include alignment holes in the generally solid block of the modular control apparatus, the holes sized and shaped to receive corresponding rods extending from the tool.

18. The apparatus of claim 17 wherein the alignment holes and corresponding rods will align in only one orientation of the modular control apparatus relative to the tool.

19. The apparatus of claim 15 wherein the generally solid block comprises an assembly of a plurality of sub-blocks.

20. The apparatus of claim 19, wherein the plurality of sub-blocks comprises:

a first sub-block containing the reservoir, the valve chamber, a portion of the first channel, the second channel, the fourth channel, the fifth channel, and at least one attachment mechanism for attaching the apparatus to the tool; and a second sub-block containing the third channel and the remaining portion of the first channel.

21. The apparatus of claim 1, further comprising a handle, the handle comprising:

a housing, shaped and sized to be griped by hand;

a channel for compressible fluid, the channel leading to an input of the modular control apparatus;

an inlet port for receiving a supply of compressible fluid into the channel; and a manually-operated valve for controlling the flow of compressible gas through the channel.

22. A modular control apparatus for a power impact tool, the tool comprising:

at least one motor, at least one housing covering the at least one motor, at least one handle, at least one manually operated valve operative to control a flow of compressible fluid from a supply thereof, and at least one part of an attachment mechanism for releasably attaching the modular control apparatus to the tool;

the modular control apparatus being releasably attachable to the tool, the apparatus further comprising at least one alignment mechanism for aligning a modular control apparatus to the tool.

23. The apparatus of claim 22 wherein the alignment mechanism and the attachment mechanism are integrated into a single mechanism.

24. A tool, comprising:

a housing;

at least one motor within the housing, the motor powered by the energy of a compressible fluid, the motor operable to rotate a drive shaft; and a modular control apparatus releasably attached to the tool, wherein the modular control apparatus comprises:

a channel for the compressible fluid, flow of the compressible fluid through the channel being controlled by an automatic valve, the channel further comprising an input port and a discharge port;

an adjustment mechanism partially protruding from the modular control apparatus the adjustment mechanism configured to be manipulated by a user of the tool;

at least one releasable mechanical connector for connecting the apparatus to the tool;

a first releasable fluid connection between the discharge port of the apparatus and a motor input port of the tool; and a second releasable fluid connection between a supply of compressed fluid and the input port of the apparatus, the second releasable fluid connection comprising at least one of a fluid connection to a compressible fluid supply hose and a fluid connection to a supply of compressible fluid from the tool.

25. The apparatus of claim 24 wherein the at least one releasable mechanical connector comprises at least one connection actuator, the connection actuator comprising a user-manipulated device for connecting and disconnecting a plurality of connections between the apparatus and the tool.

26. The apparatus of claim 25 wherein a portion of the at least one connection actuator is integral to the apparatus and the remaining portion of the connection actuator is integral to the tool.

27. A tool, comprising:

a housing;

at least one motor within the housing, the motor powered by the energy of a compressible fluid, the motor operable to rotate a drive shaft; and a modular control apparatus releasably attached to the tool, wherein the modular control apparatus comprises:

a channel for the compressible fluid, flow of the compressible fluid through the channel being controlled by an automatic valve, the channel further comprising an input port and a discharge port;

an adjustment mechanism partially protruding from the modular control apparatus, the adjustment mechanism configured to be manipulated by a user of the tool wherein the valve further comprises:

a valve chamber comprising a plurality of ports;

an actuating chamber for receiving compressible fluid from a reservoir of compressible fluid; and a valve body confined within the valve chamber and provided at least one degree of freedom of motion therein.

28. The apparatus of claim 27 wherein the actuating chamber is a portion of the valve chamber.

29. The apparatus of claim 27 wherein the actuating chamber comprises an expandible and contractible chamber.

30. The apparatus of claim 29 wherein at least one wall of the actuating chamber comprises a surface of the valve body.

31. The apparatus of claim 27 wherein the valve body contains a portion of the channel between the input port and the discharge port.

32. The apparatus of claim 27 wherein the at least one degree of freedom of motion comprises at least one degree of freedom of translational motion.

33. The apparatus of claim 27 wherein the valve further comprises a latching channel for receiving the compressible fluid into the expanded actuating chamber from the input port, the compressible fluid operative to latch the valve by maintaining the expansion of the actuating chamber.

34. The apparatus of claim 27 wherein the reservoir is configured to receive compressible fluid from the input port through a channel with a flow restriction.

35. The apparatus of claim 34 wherein the flow restriction is a variable flow restriction.

36. The apparatus of claim 35 wherein the degree of flow restriction is determined by the position of the adjustment mechanism.

37. The apparatus of claim 34 wherein the flow restriction and the adjustment mechanism together comprise a needle valve.

38. A tool, comprising:

a housing;

at least one motor within the housing, the motor powered by the energy of a compressible fluid, the motor operable to rotate a drive shaft; and a modular control apparatus releasably attached to the tool; further wherein the tool comprises a tool adapted to receive and attach to the modular control apparatus; a channel for a compressible fluid further comprising an input port and a discharge port; at least one mechanical connector;

wherein a compressible fluid supply port on the tool aligns with the compressible fluid input port on the modular apparatus when the compressible fluid discharge port of the modular control apparatus aligns with the compressible fluid motor input port on the tool and mechanical connector portions of the modular control apparatus align with the corresponding mechanical connector portions of the tool.

* * * * *

UNITED STATES PATENT AND TRADEMARK OFFICE

CERTIFICATE OF CORRECTION

PATENT NO. : 6,823,949 B2
DATED : November 30, 2004
INVENTOR(S) : David A. Giardino It is certified that error appears in the above-identified patent and that said Letters Patent is hereby corrected as shown below:

Column 2,
After line 18, preceding "Fig. 2 depicts…" insert -- Figure 1C depicts a cross-sectional view of an embodiment of a modular control apparatus manufactured of multiple blocks, in accordance with an embodiment of the present invention; --

Column 12,
Line 28, delete "The apparatus of claim 34" and insert -- The apparatus of claim 36 --

Signed and Sealed this

Fifth Day of April, 2005

JON W. DUDAS
*Director of the United States Patent and Trademark Office*